US012478853B2

(12) United States Patent
Liu

(10) Patent No.: US 12,478,853 B2
(45) Date of Patent: Nov. 25, 2025

(54) ROTARY DUMBBELL RACK

(71) Applicant: Qiduo E-Commerce (ZheJiang) Co., Ltd, Ningbo (CN)

(72) Inventor: Guangchao Liu, Ontario, CA (US)

(73) Assignee: BANCORESY TECHNOLOGY (ZHEJIANG) CO., LTD, Ningbo (CN)

( * ) Notice: Subject to any disclaimer, the term of this patent is extended or adjusted under 35 U.S.C. 154(b) by 165 days.

(21) Appl. No.: 18/368,547

(22) Filed: Sep. 14, 2023

(65) Prior Publication Data

US 2025/0090929 A1 Mar. 20, 2025

(51) Int. Cl.

| | |
|---|---|
| ***A63B 21/072*** | (2006.01) |
| ***A47F 5/02*** | (2006.01) |
| ***A63B 71/00*** | (2006.01) |

(52) U.S. Cl.

CPC ..... *A63B 71/0036* (2013.01); *A47F 5/02* (2013.01); *A63B 21/0726* (2013.01)

(58) Field of Classification Search

CPC ... A63B 49/004; A63B 2063/005; A47F 5/02; A47F 5/05

See application file for complete search history.

(56) References Cited

U.S. PATENT DOCUMENTS

| | | | | |
|---|---|---|---|---|
| D455,310 | S * | 4/2002 | Webber | D6/552 |
| 2015/0321044 | A1* | 11/2015 | English | A63B 21/072 248/415 |
| 2020/0146468 | A1* | 5/2020 | Liu | A47F 5/02 |

FOREIGN PATENT DOCUMENTS

| | | | |
|---|---|---|---|
| CN | 207462541 U | | 6/2018 |
| CN | 207950563 U | * | 10/2018 |
| CN | 214913234 U | | 11/2021 |
| CN | 215609073 U | | 1/2022 |
| CN | 222092475 U | * | 12/2024 |
| KR | 20090097548 A | * | 3/2008 |

OTHER PUBLICATIONS

Watson Gym, "Revolving Dumbbell Rack", https://watsongym.co.uk/product/revolving-dumbbell-rack/ (Year: 2013).*

BalanceFrom, "BalanceFrom PowerSpin Space Saving Dumbbell Carousel Weight Rack", https://www.walmart.com/ip/Balance From-PowerSpin-Space-Saving-Dumbbell-Carousel-Weight-Rack/1920385954 (Year: 2024).*

* cited by examiner

*Primary Examiner* — Joshua T Kennedy

(57) ABSTRACT

A rotary dumbbell rack, including a base, where expansion bolts, a rotating shaft and triangular supporting plates are provided on the base; the triangular supporting plates clamp and fix the supporting shaft on the base; bearings are provided at upper and lower ends of the supporting shaft; a rotating sleeve is sleeved outside each of the bearings; square connecting tubes are fixed on two sides of each of the rotating sleeves; an outer cylinder is arranged on the square connecting tubes; dumbbell placement plates are provided on the outer cylinder; and placement grooves are formed in each of the dumbbell placement plates.

7 Claims, 3 Drawing Sheets

ROTARY DUMBBELL RACK

TECHNICAL FIELD

The present disclosure relates to the technical field of dumbbell racks, in particular to a rotary dumbbell rack.

BACKGROUND

A dumbbell rack is an instrument for placing dumbbells. After the dumbbells are placed on the traditional dumbbell rack, the positions are fixed, the dumbbells cannot be rotated, and it is inconvenient for an exerciser to take and place the dumbbells, which brings great inconvenience to a usage process.

SUMMARY

The present invention aims to provide a rotary dumbbell rack to overcome the defects and deficiencies in the prior art.

In order to achieve the above purpose, the technical solution adopted in the present disclosure is as follows: the rotary dumbbell rack comprises a base, wherein a plurality of expansion bolts are provided on the base; a supporting shaft and a plurality of triangular supporting plates are provided on the center of the base; the triangular supporting plates are fixed on the outer surface of the supporting shaft to clamp and fix the supporting shaft; bearings are provided at upper and lower ends of the rotating shaft; a supporting sleeve is sleeved outside each of the bearings; square connecting tubes are provided on first and second opposing sides of each of the rotating sleeves; an outer cylinder is fixedly connected to the square connecting tubes by means of connecting plates and bolts; the outer cylinder and the supporting shaft are arranged in a concentric circle form; a plurality of dumbbell placement plates are provided on an outer side of the outer cylinder, every two of the dumbbell placement plates form a group, and the groups are arranged at equal intervals along the circumference; and a plurality of placement grooves are longitudinally formed in each of the dumbbell placement plates at equal intervals.

Further, a decorative cover plate is provided on the top of the outer cylinder.

Further, reinforcing plates are further provided on upper and lower ends between each of the groups of the dumbbell placement plates.

Further, a rubber pad of an arc-shaped structure is sleeved on each of the placement grooves.

Further, the base is of a flower-shaped structure.

Further, the square connecting tubes at the upper and lower ends of the supporting shaft are distributed in a cross shape in space.

Further, the bearings are fixed by means of hoops, and the bearings are fixedly connected to the rotating sleeves by means of inner hoops.

With the adoption of the above structure, the present disclosure has the beneficial effects as follows:

the present disclosure is simple in structure and convenient to use; and through arrangement of the supporting shaft, the bearings and the outer cylinder, the dumbbell placement plates can rotate freely, thereby driving dumbbells to rotate freely, and facilitating an exerciser taking and placing the dumbbells of different specifications according to needs.

DESCRIPTION OF REFERENCE NUMERALS

1. base, 2. expansion bolt, 3. supporting shaft, 4. triangular supporting plate, 5. bearing, 6. rotating sleeve, 7. square connecting tube, 8. connecting plate, 9. bolt, 10. outer cylinder, 11. dumbbell placement plate, 12. placement groove, 13. decorative cover plate, 14. reinforcing plate, 15. rubber pad, 16. outer hoop, and 17. inner hoop.

DETAILED DESCRIPTION OF THE EMBODIMENTS

The present disclosure is further described below in combination with the accompanying drawings.

In order to make the purposes, technical solutions and advantages of the present disclosure more clear, the present disclosure is further described in detail in combination with the accompanying drawings and specific embodiments below. It should be understood that the specific embodiments described herein are only used to explain the present disclosure, not to define the present disclosure.

Figure 1:
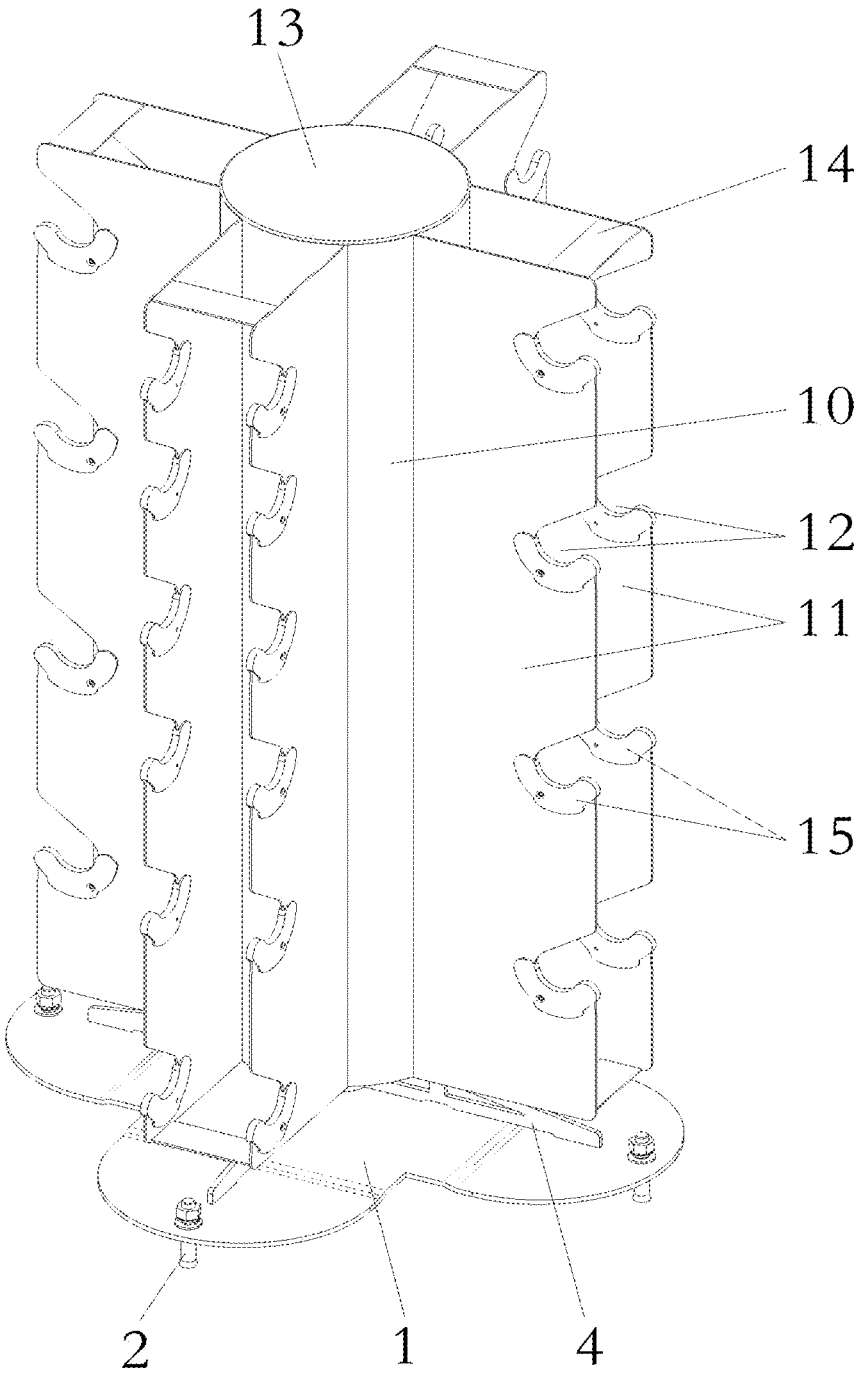
FIG. 1 is a three-dimensional structure diagram of the present disclosure.
Figure 2:
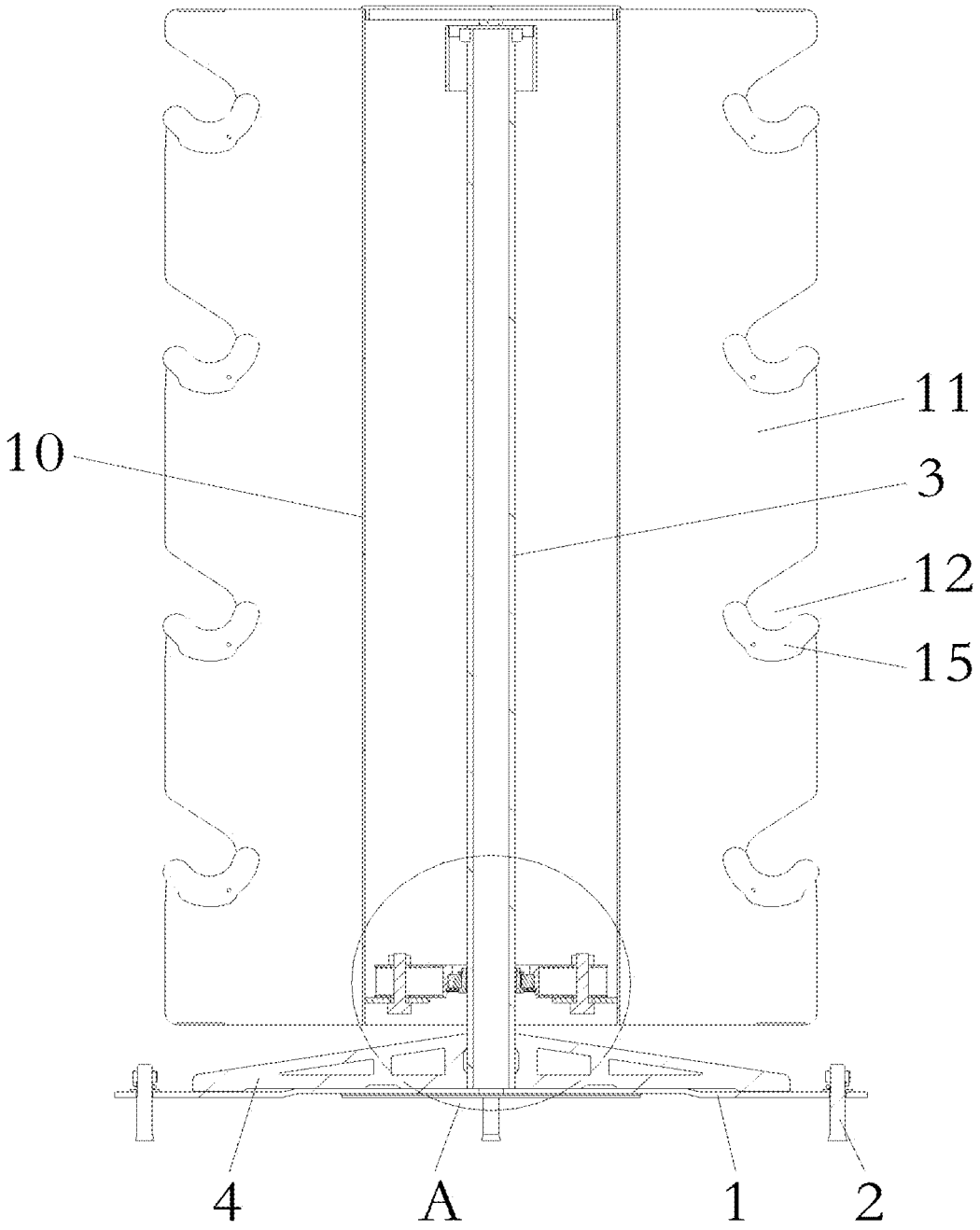
FIG. 2 is a section view of the present disclosure.
Figure 3:
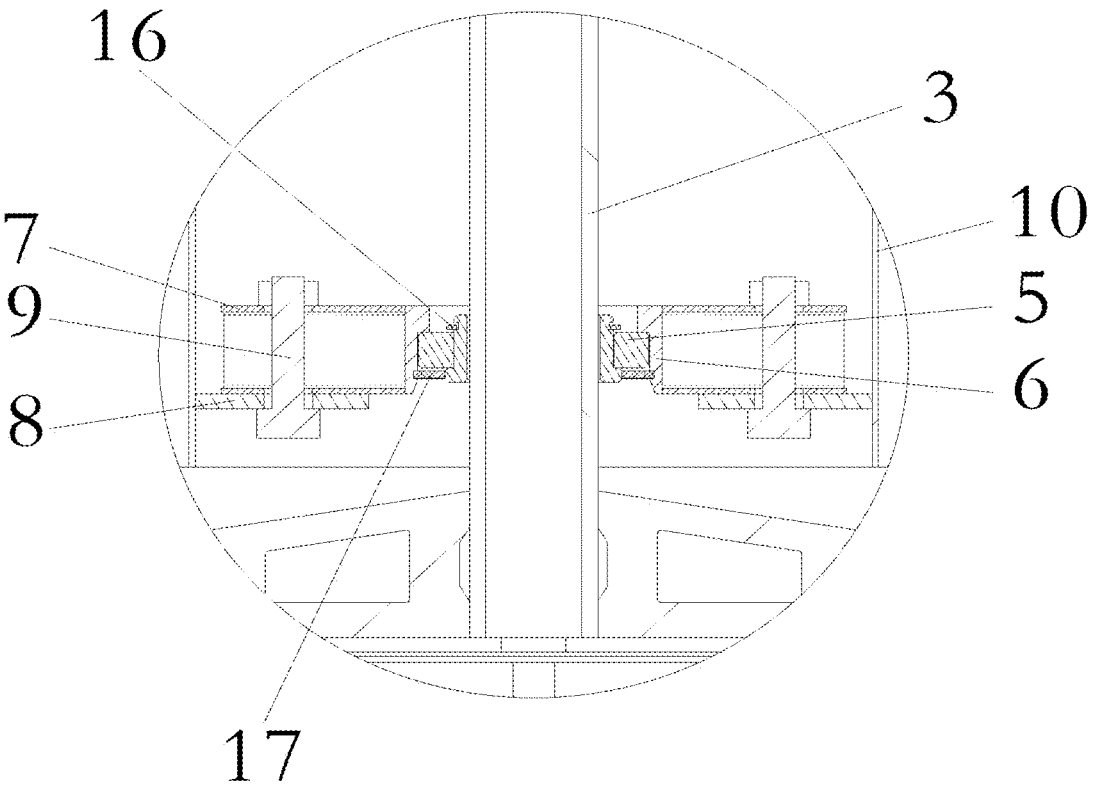
FIG. 3 is an enlarged view at A in FIG. 2.

Reference is made to FIGS. 1-3. A rotary dumbbell rack includes a base 1, wherein a plurality of expansion bolts 2 are provided on the base 1;

a supporting shaft 3 and a plurality of triangular supporting plates 4 are provided on the center of the base 1; the triangular supporting plates 4 are fixed on the outer surface of the supporting shaft 3 to clamp and fix the rotating shaft 3 on the base 1; bearings 5 are provided at upper and lower ends of the supporting shaft 3; a rotating sleeve 6 is sleeved outside each of the bearings 5; square connecting tubes 7 are fixed on first and second opposing sides of each of the rotating sleeves 6; an outer cylinder 10 is fixedly connected to the square connecting tubes 7 by means of connecting plates 8 and bolts 9; the outer cylinder 10 and the supporting shaft 3 are arranged in a concentric circle form; a plurality of dumbbell placement plates 11 are provided on an outer side of the outer cylinder 10, every two of the dumbbell placement plates 11 form a group, and the groups are arranged at equal intervals along the circumference; and a plurality of placement grooves 12 are longitudinally formed in each of the dumbbell placement plates 11 at equal intervals. Specifically, dumbbells are placed in the placement grooves 12, and the dumbbell placement plates 11 can rotate around the supporting shaft 3 by means of the outer cylinder 10 and the bearings 5, thereby driving the dumbbells to rotate freely, and facilitating an exerciser taking and placing the dumbbells of different specifications according to needs.

In this embodiment, a decorative cover plate 13 is provided on the top of the outer cylinder 10. The top of the outer cylinder 10 is sealed by means of the decorative cover plate 13, and thus the attractiveness is improved.

In this embodiment, reinforcing plates 14 are further provided on upper and lower ends between each of the groups of the dumbbell placement plates 11, which is conducive to the stability between each group of the dumbbell placement plates 11.

In this embodiment, a rubber pad 15 of an arc-shaped structure is sleeved on each of the placement grooves 12; therefore, on one hand, damage to the dumbbells is avoided, and on the other hand, noises produced when the dumbbells are placed are reduced.

In this embodiment, the base 1 is of a flower-shaped structure, which improves the attractiveness. The shape of the base 1 is not limited to the flower-shaped structure, and may be other shapes.

In this embodiment, the square connecting tubes 7 at the upper and lower ends of the supporting shaft 3 are distributed in a cross shape in space, which is conducive to the connection stability of the outer cylinder 10.

In this embodiment, the bearings 5 are fixed by means of outer hoops 16, and the bearings 5 are fixedly connected to the rotating sleeves 6 by means of inner hoops 17. Therefore, later maintenance and replacement of parts are facilitated.

The above description is only used to illustrate the technical solutions of the present disclosure, not to limit the present disclosure; and other modifications or equivalent replacements made by those of ordinary skill in the art on the technical solutions of the present disclosure should fall within the scope of claims of the present disclosure as long as such modifications or equivalent replacements do not deviate from the spirit and scope of the technical solutions of the present disclosure.

What is claimed is:

1. A rotary dumbbell rack, comprising a base, wherein a plurality of expansion bolts are provided on the base; a supporting shaft and a plurality of triangular supporting plates are provided on the center of the base; the triangular supporting plates are fixed on the surface of the supporting shaft to clamp and fix the supporting shaft on the base; bearings are provided at upper and lower ends of the supporting shaft; a rotating sleeve is sleeved outside each of the bearings; square connecting tubes are fixed on first and second opposing sides of each of the rotating sleeves; an outer cylinder is fixedly connected to the square connecting tubes by means of connecting plates and bolts; the outer cylinder and the supporting shaft are arranged in a concentric circle form; a plurality of dumbbell placement plates are provided on an outer side of the outer cylinder, every two of the dumbbell placement plates form a group, and the groups are arranged at equal intervals along the circumference; and a plurality of placement grooves are longitudinally formed in each of the dumbbell placement plates at equal intervals.

2. The rotary dumbbell rack according to claim 1, wherein a decorative cover plate is provided on the top of the outer cylinder.

3. The rotary dumbbell rack according to claim 1, wherein reinforcing plates are further provided on upper and lower ends between each of the groups of the dumbbell placement plates.

4. The rotary dumbbell rack according to claim 1, wherein a rubber pad of an arc-shaped structure is sleeved on each of the placement grooves.

5. The rotary dumbbell rack according to claim 1, wherein the base is of a flower-shaped structure.

6. The rotary dumbbell rack according to claim 1, wherein the square connecting tubes at the upper and lower ends of the supporting shaft are distributed in a cross shape.

7. The rotary dumbbell rack according to claim 1, wherein the bearings are fixed by means of outer hoops, and the bearings are fixedly connected to the rotating sleeves by means of inner hoops.

* * * * *